United States Patent [19]

Levenberg

[11] 4,301,785

[45] Nov. 24, 1981

[54] ADJUSTABLE FLUE CONTROL FOR FURNACES

[76] Inventor: Nat Levenberg, 2 Windsor Pl., Lynbrook, N.Y. 11563

[21] Appl. No.: 144,595

[22] Filed: Apr. 28, 1980

[51] Int. Cl.[3] ..... F23L 3/00

[52] U.S. Cl. ..... 126/292; 236/45

[58] Field of Search ..... 126/285 R, 289–293, 126/286, 307 A; 236/1 G, 45

[56] References Cited

U.S. PATENT DOCUMENTS

| | | | |
|---|---|---|---|
| 2,194,608 | 3/1940 | Miller | 236/45 |
| 2,620,984 | 12/1952 | Larsen | 236/45 |
| 2,650,029 | 8/1953 | Field | 236/45 |
| 2,819,845 | 1/1958 | Ziph | 236/45 |
| 3,070,312 | 12/1962 | Steinen | 236/45 |
| 3,362,634 | 1/1968 | Steinen | 236/45 |

*Primary Examiner*—James C. Yeung

*Attorney, Agent, or Firm*—Charles E. Temko

[57] ABSTRACT

A damper type control for furnace flues which opens with commencement of oil burner operation and closes when combustion ceases. The damper is operated solely by the presence of draft created by the oil burner blower, and closes in the absence of such draft under the influence of a counterweight. With the occurrence of wind passing the open end of the flue, the pressure differential on either side of the damper also assists in maintaining the damper in closed condition.

2 Claims, 5 Drawing Figures

ADJUSTABLE FLUE CONTROL FOR FURNACES

BACKGROUND OF THE INVENTION

This invention relates generally to the field of flue dampers for conducting the products of combustion in a furnace to the outside atmosphere. More particularly, it relates to an improved construction of this type of relatively simple design permitting correspondingly low cost of manufacture, and with high reliability in operation. Devices of this general type are well known in the art, and the invention lies in specific constructional details which permit these advantages.

In those installations having a gun type oil burner, it is common practice to provide a side vent which employs a counter balanced butterfly valve to establish periodic communication between the lower end of the flue and the furnace room. When this valve is open, air flows from the furnace room to the flue to maintain draft emanating from the oil burner at a relatively constant level during burner operation. However, when the burner is not in operation, a substantial wind passing the open end of the flue will also draw warm air from the furnace plenum and thereby waste fuel necessary to reheat the plenum when the burner commences a subsequent cycle of operation.

With the rapid increase in the cost of petroleum fuels, attempts have been made to provide a flue damper which will positively close the flue above the side vent to stop the flow of warm air up the flue when the burner cycle has ended. A common type includes a butterfly type valve operated by a motor or an electrical solenoid energized simultaneously with the oil burner motor. While effective, this construction is quite costly, and requires the efforts of both an electrician and a plumber to install.

Somewhat simpler structures are described in the United States patent to Sabins, U.S. Pat. No. 2,264,590 granted Dec. 2, 1941, and a series of patents granted to Steinen, namely U.S. Pat. Nos. 2,904,255 of Sept. 15, 1951; 2,990,118 granted June 27, 1961; 3,070,312 granted Dec. 25, 1962; and 3,077,305 granted Feb. 12, 1963. Each of the above patents teaches an in-line damper of butterfly valve type having adjustable weights on either side thereof to provide a high degree of sensitivity to the existence of a pressure differential on either side of the valve. The present invention is directed to valve construction of this general type.

SUMMARY OF THE INVENTION

Briefly stated, the present invention lies in the provision of an improved counterbalanced butterfly valve construction which is readily adapted for installation in either horizontal or vertical orientation, depending upon the situs of installation, or at any angular disposition therebetween. In addition to the provision of the usual relatively heavy weights mounted on either side of the valve, and laterally displaced with respect to the plane thereof, a third weight element is disposed on one side of the valve, the position of which is shiftable within a plane parallel to the plane of the valve, rather than along an axis at right angle thereto. This weight is normally located close to the axis of rotation of the vane of the valve so that relatively little adjustment is needed to obtain the proper balance at vertical or horizontal position. This adjustment is accessible to service personnel, after the valve has been completely installed and tested, without the necessity of disassembling that portion of the flue in which the valve is located.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
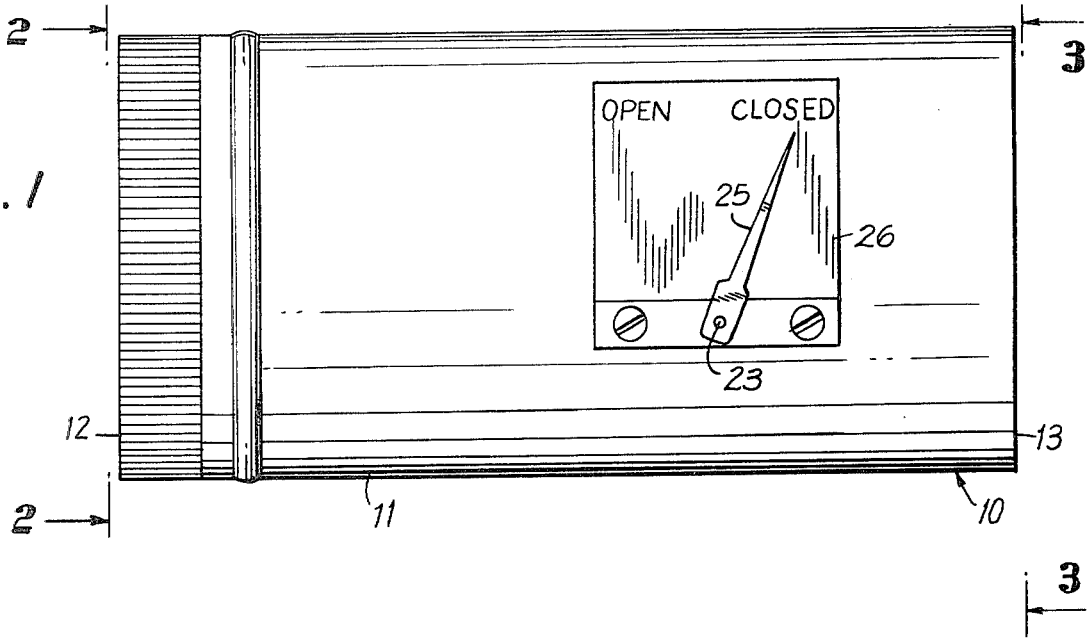
FIG. 1 is a side elevational view of an embodiment of the invention.
Figure 2:
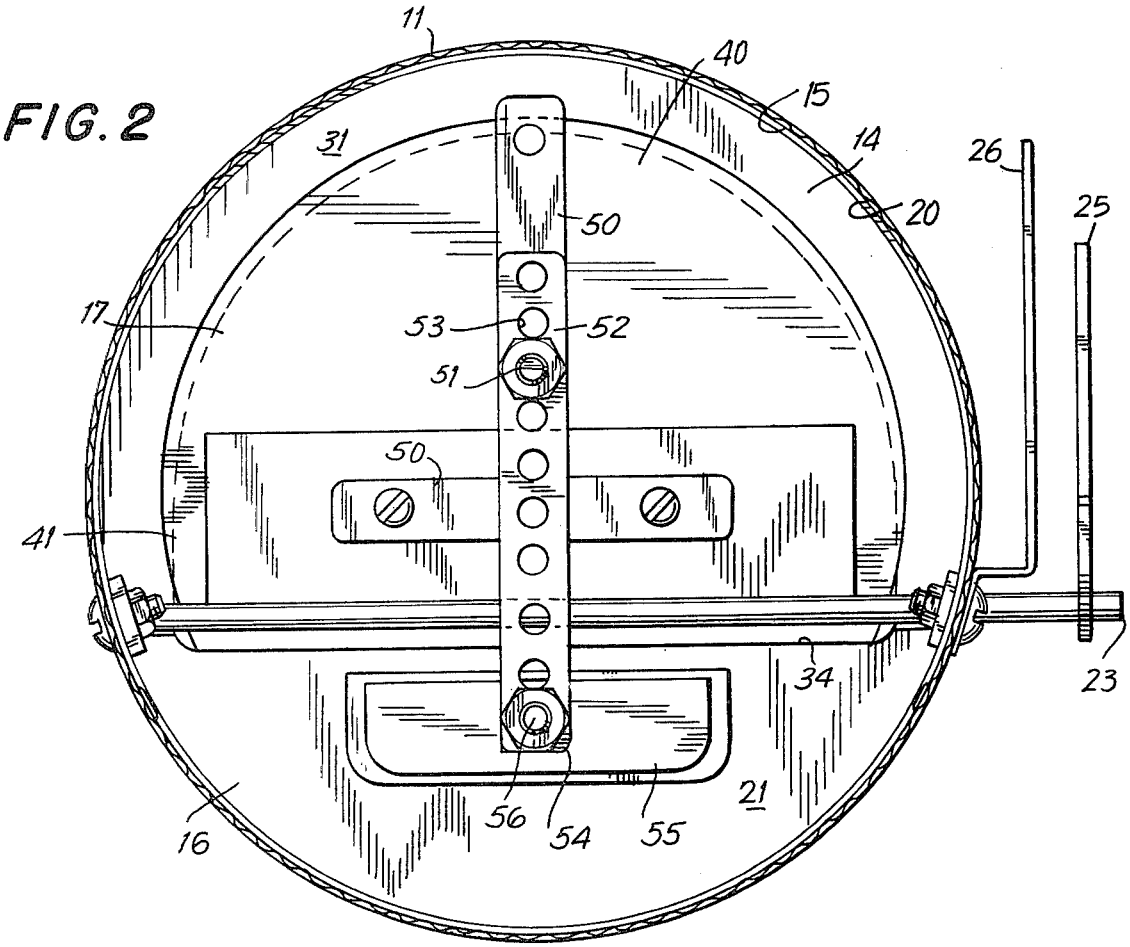
FIG. 2 is an end elevational view thereof as seen from the left hand portion of FIG. 1.
Figure 5:
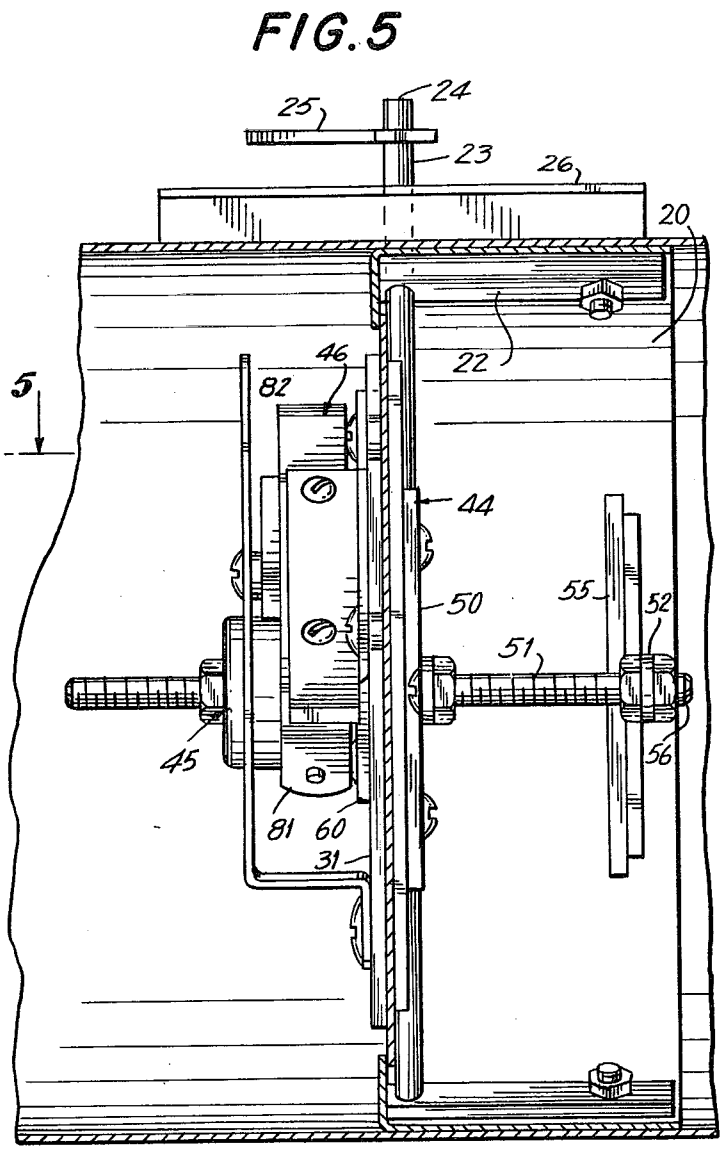
FIG. 5 is a sectional view thereof as seen from the plane 5—5 in FIG. 3.
Figure 3:
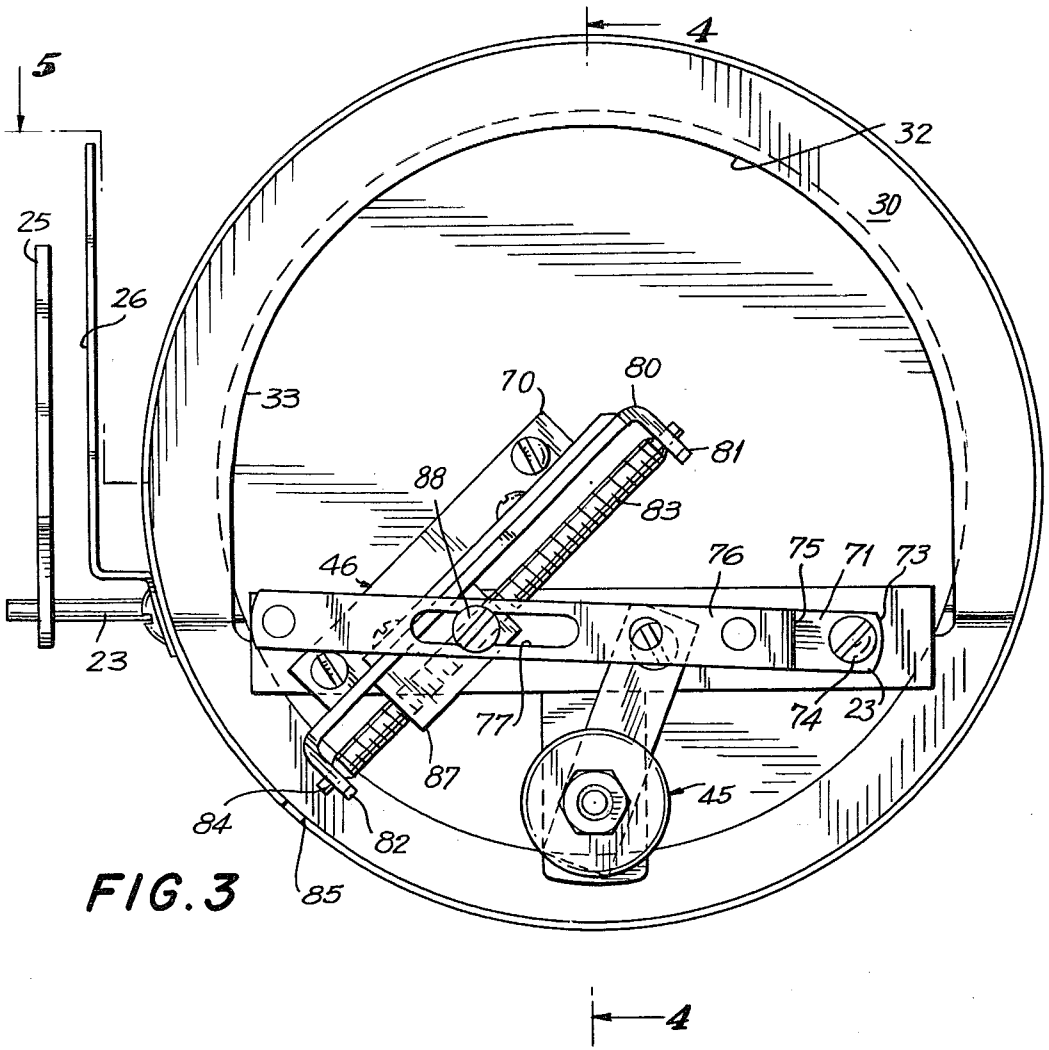
FIG. 3 is a second end elevational view thereof as seen from the right hand portion of FIG. 1.
Figure 4:
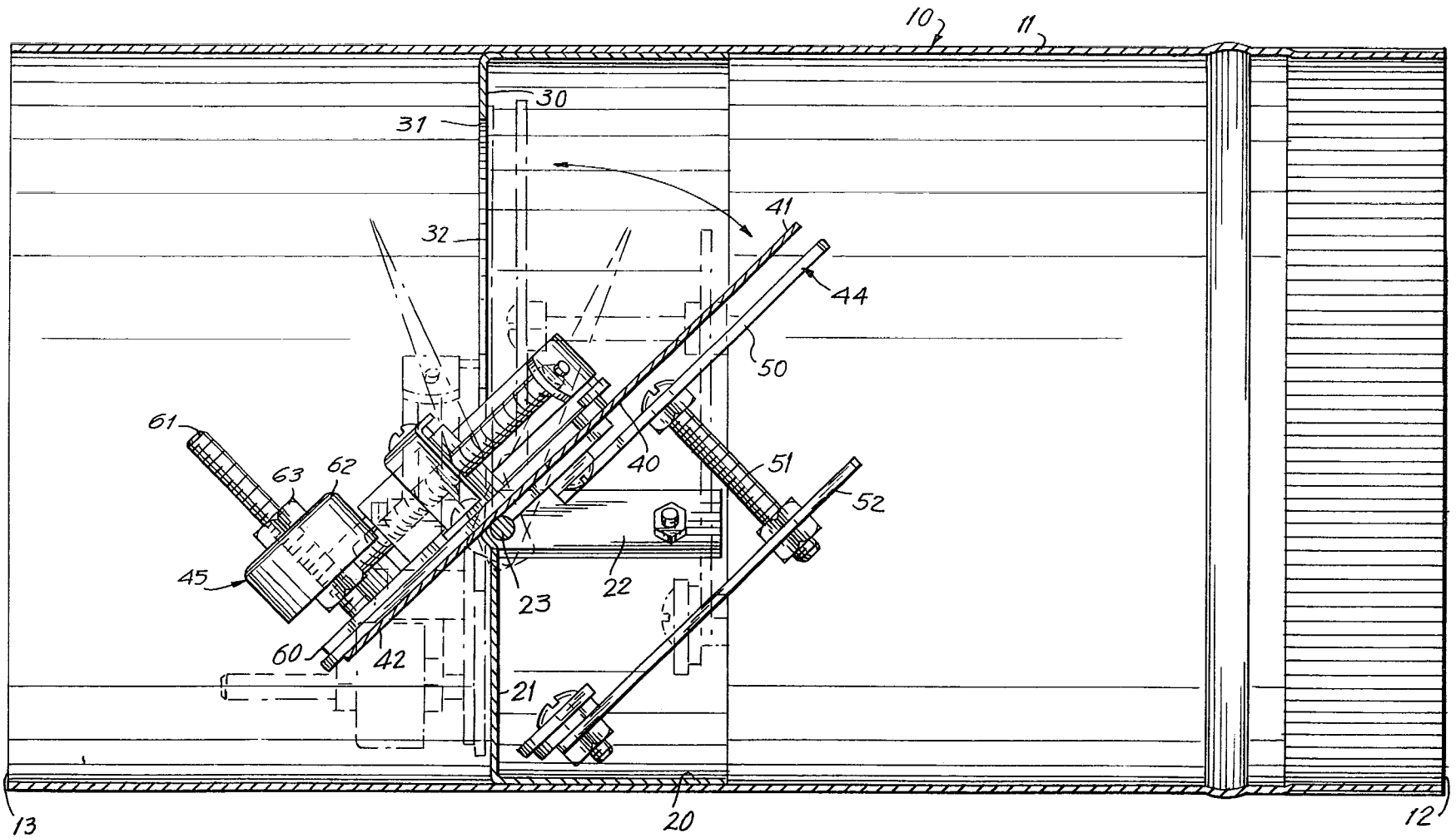
FIG. 4 is a sectional view as seen from the plane 4—4 in FIG. 3, but showing certain of the component parts in altered relative position.

In accordance with the invention, the device, generally indicated by reference character 10, includes a length of flue pipe 11, having a first end 12 which forms part of a flue (not shown) leading to a furnace, and a second end 13 forming part of the flue leading to the outside atmosphere. Disposed within the pipe 11, is a valve body 14 (see FIGS. 2 and 3) secured to the inner surface 15 thereof by welding or other suitable means. The valve body 14 includes a fixed element 16 and a movable element 17.

The element 16 includes a cylindrical sleeve 20 mounting an orificed transversely extending planar member 21, and a pair of bearing members 22 which support a transversely extending shaft 23 upon which the movable element 17 is mounted. One end 24 of the shaft 23 extends through an opening in the pipe 11 and mounts an indicator 25 which cooperates with an indicia plate 26 to indicate to a viewer whether the movable element 17 is opened or closed position relative to the fixed element 16.

The planar member 21 is bounded by first and second surfaces 30 and 31, respectively, surrounding a through opening 32 extending there between, the opening being bounded by a curved edge 33 and a rectilinear edge 34.

The movable element 17 includes a generally circular plate 40 formed by a relatively larger portion 41 and a relatively smaller offset portion 42 between which the shaft 23 extends. Mounted on the plate 40 are first, second and third weight elements, 44, 45, and 46, respectively.

The first weight element 44 includes a mounting plate 50 secured to the surface 30 from which an axially disposed member 51 extends. The member 51 supports a transversely disposed member 52 having a plurality of adjustment holes 53. A free end 54 mounts a weight 55 which may be secured thereto by threaded means 56. For purposes of adjustment, it is necessary only that the weight 55 be shiftable in a plane generally parallel to that of the plate 40.

The second weight element 45 includes a mounting plate 60 secured to the surface 31 from which a threaded shank 61 extends in a generally axial direction perpendicular to the plane of the surface 31. A weight 62 is shiftable along the shank 61, and is fixed in position by a nut 63. Adjustment of the element 45 need normally occur only in a direction along the shank 61.

The third weight element 46, unlike the elements 44 and 45, is accessible to service personnel after the device 10 has been installed. It includes a first fixed member 70, and a second pivotally mounted member 71. The member 70 includes a terminal portion 73 secured by a pivot screw 74, and a laterally extending portion 75 having a transversely extending portion 76 extending therefrom, the latter member having an elongated slot 77 therein. The second member 71 includes a transversely extending bracket 80 secured to the surface 41 having first and second oppositely disposed ends 81 and 82 mounting a threaded member 83 for relative rotation. The member 83 has a free end 84 selectively positionable opposite an opening 85 in the pipe 11, the end 84 having tool engagement means whereby it may be rotated by a screwdriver (not shown) or other suitable tool. A threaded weight 87 is carried by the threaded member 83, and is penetrated by a screw 88 which also engages the slot 77 to prevent rotation of the weight upon the member 83 and any possible binding during adjustment.

Prior to installation, the device may be adjusted to reasonable precision using only the first and second weight elements, the third weight element being adjusted so that the position of the weight 87 is near the axis of the shaft 23. When the pipe 11 has been interconnected with corresponding members of the flue, operation can then be checked by actually operating the oil burner, and observing the movement of the member 25 relative to the member 26. Should further adjustment be necessary, it is only necessary to interrupt operation of the burner causing the valve to close, at which time the end 84 aligns itself with the opening 85, permitting final adjustment by shifting the weight 87.

I wish it to be understood that I do not consider the invention limited to the precise details of structure shown and set forth in this specification, for obvious modifications will occur to those skilled in the art to which the invention pertains.

I claim:

1. In a furnace flue damper construction, including a length of flue pipe, an orificed plate positioned transversely with respect to the principal axis of said pipe, and a butterfly type valve member pivotally mounted with respect to said orificed plate to selectively close an orifice therein, the improvement comprising: first, second and third weight elements mounted upon and pivoting with said valve member; said first weight member being mounted upon a first side of said valve member, and having means for adjustment laterally with respect to the plane of said valve member; said second weight member being mounted on a second side of said valve member and having means for adjustment in a plane parallel to the plane of said valve member; said third weight member including a bracket mounted upon said first side of said valve member, said bracket member rotatably mounting an elongated threaded member having a free end thereof having tool engaging means thereon, said flue pipe having an opening therein for access to said free end when said valve member is in predetermined position relative to said pipe, and weight means threadably engaged upon said threaded member for movement there along with rotation of said threaded member in a plane parallel to the plane of said valve member, said last mentioned weight being shiftable across the pivotal axis of said valve member.

2. The improvement in accordance with claim 1, further characterized in the provision of a pivotally mounted member secured to said last mentioned bracket, said member having an elongated slot therein, and a screw penetrating said slot and threadably engaging said last mentioned weighted member for preventing rotation of said weighted member relative to said threaded member.

* * * * *